US006590554B1

(12) United States Patent
Takayama

(10) Patent No.: US 6,590,554 B1
(45) Date of Patent: Jul. 8, 2003

(54) COLOR IMAGE DISPLAY SYSTEM

(75) Inventor: Ichiro Takayama, Tokyo (JP)

(73) Assignee: TDK Corporation, Tokyo (JP)

( * ) Notice: Subject to any disclaimer, the term of this patent is extended or adjusted under 35 U.S.C. 154(b) by 175 days.

(21) Appl. No.: 09/702,743

(22) Filed: Nov. 1, 2000

(30) Foreign Application Priority Data

Dec. 10, 1999 (JP) ..... 11-315604

(51) Int. Cl.[7] ..... G09G 3/36; G09G 5/00

(52) U.S. Cl. ..... 345/92; 345/8; 345/7; 345/94; 345/95; 345/204; 345/205

(58) Field of Search ..... 345/92, 87, 94, 345/95, 96, 204, 205, 206, 208, 209, 76; 348/675, 655; 315/169.3

(56) References Cited

U.S. PATENT DOCUMENTS 4,951,041 A * 8/1990 Inada et al. ..... 345/691
5,296,920 A * 3/1994 Sakaue et al. ..... 348/675
5,479,272 A * 12/1995 Saito ..... 358/518
5,684,365 A * 11/1997 Tang et al. ..... 257/448
6,400,347 B1 * 6/2002 Kang ..... 345/68

OTHER PUBLICATIONS

T.P. Brody, et al., "A 6 =6–IN 20–LPI Electroluminescent Display Panel", IEEE Transactions on Electron Devices, vol, ED–22, No. 9, Sep. 1975, pp. 739–748.

* cited by examiner

*Primary Examiner*—Bipin Shalwala
*Assistant Examiner*—Prabodh Dharia
(74) *Attorney, Agent, or Firm*—Oblon, Spivak, McClelland, Maier & Neustadt, P.C.

(57) ABSTRACT

A color image display system including a thin-film display device is provided. The device is driven by a current for each pixel of the device and is designed to display colors corresponding to a plurality of color signals. The display system includes a color signal converter for converting the color signal ratio of the plurality of color signals of a color signal source to a ratio of signals suitable for the colors of the thin-film display device. In this way, the color image display system provides an improved image quality, even when colors of light emitted from the thin-film display device are slight variations from NTSC or other image signals, or the current/luminance conversion efficiencies for various colors are not the same level.

6 Claims, 9 Drawing Sheets

COLOR IMAGE DISPLAY SYSTEM

BACKGROUND OF THE INVENTION

1. Technical Art

The present invention relates generally to an image display system using thin-film light emitting devices, and more particularly to an image display system of high image quality, which is suitable for an organic electroluminescence (EL) display system.

2. Background Art

In recent years, display systems using organic EL devices are developed. When an organic EL device system comprising a multiplicity of organic EL devices is driven by an active matrix circuit, pixels of each EL are each connected with a set of FETs (field effect transistors) like thin-film transistors (TFTs) for controlling a current fed to each pixel. In other words, each pixel is connected with a set of a biasing TFT for feeding a driving current to an organic EL device and a switching TFT indicative of whether or not that biasing TFT is to be selected.

FIGS. 12 and 13 shows one example of the circuit diagram for a conventional active matrix type organic EL display system. This organic EL display system 310 are built up of X-direction signal lines X1, X2, . . . , Y-direction signal lines Y1, Y2, . . . , power source Vdd lines Vdd1, Vdd2, . . . , switching transistors (TFTs) Ty11, 12, Ty21, 22, . . . , current controlling transistors (TFTS) M11, M12, M21, M22, . . . , organic EL devices EL110, 120, EL210, 220, . . . , capacitors C11, 12, C21, 22, . . . , an X-direction peripheral driving circuit (shift register X-axis) 312, a Y-direction peripheral driving circuit (shift register Y-axis) 313, a screen 311, and so on.

A pixel is specified by X-direction signal lines X1, X2 and Y-direction signal lines Y1, Y2. At that pixel, switching transistors Ty11, 12, Ty21, 22 are put on, so that image data are held on signal holding capacitors C11, 12, C21, 22. This in turn puts on current controlling transistors M11, 12, M21, 22, so that biasing currents corresponding to the image data are passed through organic EL devices EL110, 120, EL210, 220 via power source lines Vdd1, Vdd2 for light emission.

For instance, as signals corresponding to the image data are produced at X-direction signal line X1 and Y-direction scanning signals are produced at Y-direction signal line Y1, switching TFT transistor Ty11 for the pixel specified thereby is put on, so that current controlling transistor M11 is brought into conduction by signals corresponding to the image data, whereupon a light emission current corresponding to the image data is passed through organic EL device EL110 for light emission control. In an active matrix type EL image display system comprising, per pixel, a thin-film type EL device, a current controlling transistor for controlling the light emission of the EL device, a signal holding capacitor connected to a gate electrode of the current controlling transistor, a switching transistor for writing data into the capacitor, etc., the light emission intensity of the EL device is thus determined by a current passing through the transistor that is a light emission current controlling non-linear device controlled by a voltage built in the signal holding capacitor (see A66-in 201pi Electroluminescent Display T. P. Brody, F. C. Luo, et. al, IEEE Trans Electron I devices, Vol. ED-22, No. 9, September 1975, P739–749).

Referring here to a full-color display system, light emission in various colors is achievable by making a selection from light-emitting organic EL materials. Alternatively, light emission in colors from blue to red is achievable by passing light emitted from an organic EL device through a color filter, provided that the organic EL device is made up of a material capable of emitting white light. As well known in the art, the full-color display system may be obtained by locating a display device emitting the three primary colors red, green and blue for each pixel.

In the case of a full-color display, its image signals are formed by a color image receiver. However, the signal amplitude ratio of each color obtained by the receiver is not necessarily in agreement with the ratio of a current value for driving each color of an EL device. Referring to the NTSC image signals as an example, white is represented by a ratio of red 0.3:green 0.59:blue 0.11. However, even though such signals are entered into a full-color EL display just as they are, it is then impossible to obtain white. This is because colors of light emitted from EL are delicately different from the NTSC red, green and blue and, at the same time, the current/luminance conversion efficiencies for colors from EL are not the same level.

SUMMARY OF THE INVENTION

An object of the present invention is to provide a color image display system which can achieve a proper color display and so form an image of high image quality, even when colors of light emitted from thin-film display devices are delicately different from NTSC or other image signals or the current/luminance conversion efficiencies for various colors are not the same level.

The aforesaid object is achieved by the inventions defined below.

(1) A color image display system comprising a thin-film display device driven by a current for each pixel 7 and designed to display colors corresponding to a plurality of color signals 3R, 3G and 3B, which further comprises:

a color signal conversion means 4 for converting the color signal ratio of said plurality of color signals 3R, 3G and 3B sent out of a color signal source 2 to the ratio of signals 5R, 5G and 5B suitable for the colors of said thin-film display devices.

(2) The color image display system according to (1) above, wherein said color signal conversion means is formed on the same substrate as that of said thin-film display device.

(3) The color image display system according to (1) or (2) above, which further comprises a light emission controlling device for feeding a driving current to at least said thin-film display device, and wherein said color signal conversion means is controlled in such a way that the input signal/output signal characteristics of said light emission controlling device correspond to each color to be displayed.

(4) The color image display system according to (3) above, wherein said light emission controlling device is a polysilicon TFT.

(5) The color image display system according to (3) or (4) above, wherein said input signal/output signal characteristics are a TFT transconductance.

(6) The color image display system according to any one of (1) to (5) above, wherein said thin-film display device is an organic EL device.

BEST MODE OF CARRYING OUT THE INVENTION

Figure 1:
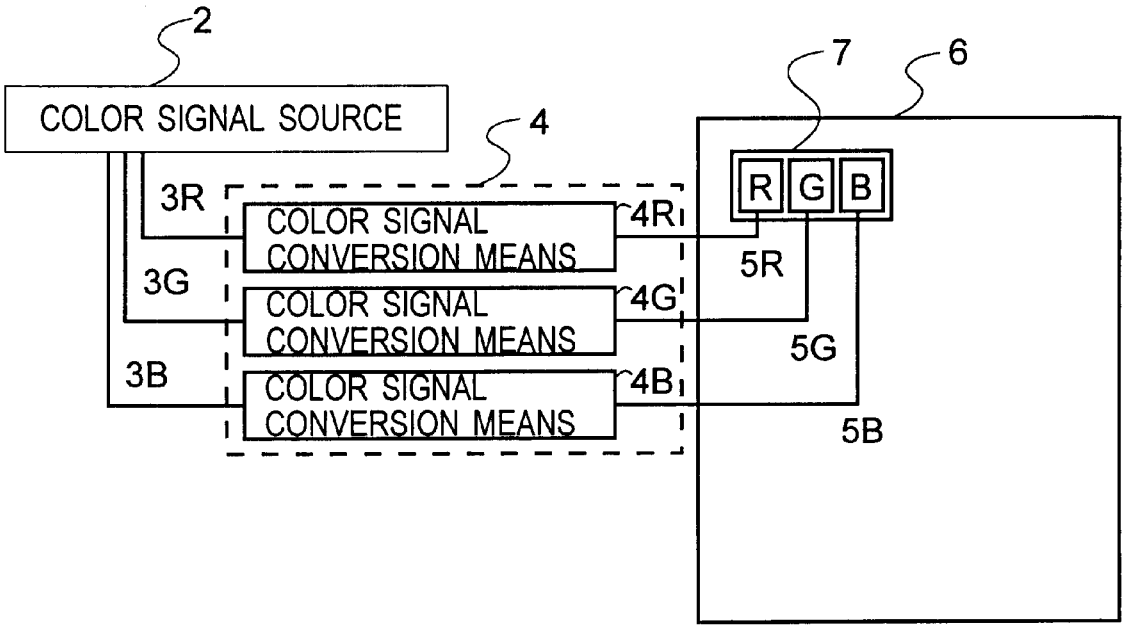
FIG. 1 is a block diagram illustrative of the basic construction of the image display system according to the present invention.

As shown in FIG. 1 for instance, the color image display system of the present invention comprises a thin-film display device driven by a current for each pixel 7, and is designed to display colors R, G and B corresponding to a plurality of color signals 3R, 3G and 3B. The color image display system further comprises a color signal conversion means 4 for converting the color signal ratio of the plurality of color signals 3R, 3G and 3B sent out of a color signal source 2 to the ratio of signals suitable for the colors R, G and B.

By using the signal conversion means 4 for converting the plurality of color signals 3R, 3G and 3B sent out of the color signal source 2 to the optimum signal values in conformity with the characteristics of the thin-film display devices, which vary for each of the colors R, G and B to be displayed, it is thus possible to obtain a proper color display even with thin-film display devices which emit colors delicately different from signal colors from a signal source and wherein the current/luminance conversion efficiencies are not on the same level.

Reference is again made to FIG. 1 that is a block diagram illustrative of the basic construction of the color image display system according to the present invention. The color image display system of the invention comprises a color signal conversion means 4 for converting a plurality of color signals 3R, 3G and 3B sent out of a color signal source 2 such as a color image receiver to the optimum signal values in conformity with the characteristics of thin-film display devices, which vary for each of colors R, G and B to be displayed. Color signal conversion means 4 (4R, 4G and 4B) may be provided in correspondence to a plurality of color signals 3R, 3G and 3B. Alternatively, the color signal conversion means 4 may be provided in the form of a unit capable of addressing a plurality of color signals 3R, 3G and 3B.

At the respective color signal conversion means 4R, 4G and 4B, the color signals 3R, 3G and 3B are converted to color signals 5R, 5G and 5B at levels suitable for displaying colors R, G and B at the thin-film light emitting devices, and then produced therefrom.

The converted color signals 5R, 5G and 5B are fed to pixels 7 in a display block 6 to drive thin-film light emitting devices corresponding to the colors R, G and B to be displayed. Corresponding to a display portion for displaying images or desired contents, this display block 6 is made up of a plurality of thin-film light emitting devices providing pixels 7.

No particular limitation is imposed on the color signal source used; any desired source capable of producing plural kinds of color signals may be used. To be specific, use may be made of image pickup devices such as television cameras, television signal receivers, laser disc players, DVD players, video players, computer systems such as personal computers, etc. From such equipment, color signals (image signals) in colors are produced at a given signal ratio of R (red) 0.3:G (green) 0.59:B (blue) 0.11 typically used for the NTSC operation mode, i.e., at a signal level at which the respective colors can be faithfully reproduced.

The color signal conversion means 4R, 4G and 4B convert a plurality of color signals obtained from the color signal source 2 to signals that enable proper display colors to be obtained by the thin-film light emitting devices. In other words, the aforesaid given signal ratio (signal level) of R (red) 0.3:G (green) 0.59:B (blue) 0.11 is converted to the signal ratio (signal level) at which proper color reproduction can be achieved in conformity with the characteristics of the thin-film light emitting devices.

This is embodied as follows.

Figure 2:
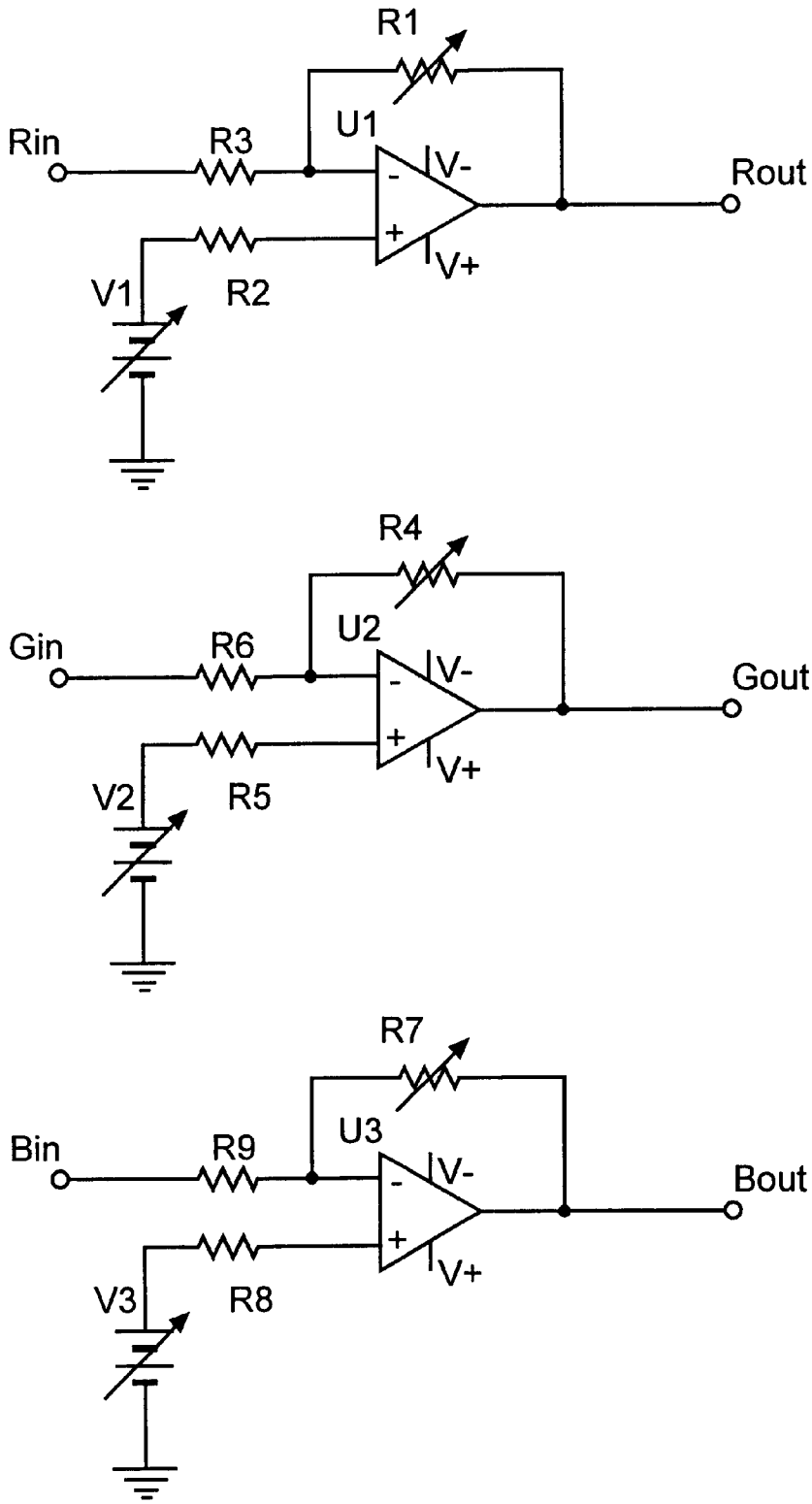
FIG. 2 is a circuit diagram illustrative of the first embodiment of the color signal conversion means in the image display system of the invention.

In the first embodiment of the present invention, three video amplifiers U1, U2 and U3 are provided corresponding to the colors R, G and B to be displayed, as shown in FIG. 2. In addition, means V1, V2 and V3 for controlling the offset voltages of video amplifiers U1, U2 and U3 and means R1, R4 and R7 for controlling the amplification factors thereof are provided. This enables the color signals to be converted to signals suitable for the colors of thin-film light emitting devices, and then entered into the thin-film light emitting devices.

Referring back to FIG. 1, color signals (video signals) are entered in the minus inputs (−) of the video amplifiers U1, U2 and U3 from input terminals Rin, Gin and Bin via input resistors R3, R6 and R9, respectively. Between the minus inputs (−) and amplifier outputs and output terminals Rout, Gout and Bout there are connected feedback resistors R1, R4 and R7 to gain feedback ratio control or amplification factor control. In addition, the video amplifiers U1, U2 and U3 are connected at their plus inputs (+) with offset voltage sources V1, V2 and V3 having variable outputs via limiting resistors R2, R5 and R8, so that offset voltages can be controlled.

Figure 3:
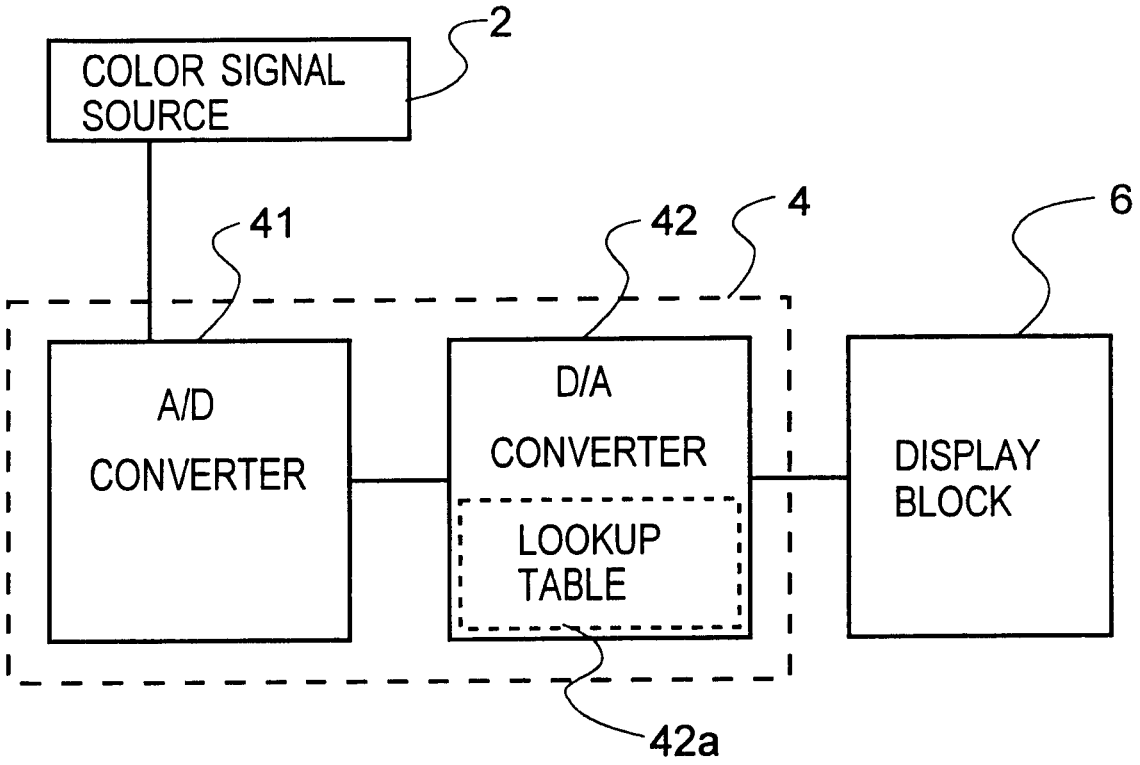
FIG. 3 is a block diagram illustrative of the second embodiment of the color signal conversion means in the image display system of the invention.

In the second embodiment of the present invention, weights for colors are assigned to the lookup table of an A/D or D/A converter. In other words, as shown in FIG. 3, color signals sent out of the color signal source 2 are entered in an A/D converter 41 where they are A/D converted, and then entered in a D/A converter 42 where they are D/A converted, thereby driving pixels in the display portion 6. If, in this case, a given weight is assigned to a lookup table 42*a* of D/A converter 42 in such a way as to provide signal conversion in conformity with the characteristics of the thin-film devices to be driven, it is then possible to enter the color signals in the pixels after they are converted to signals suitable for the colors of the thin-film light emitting devices.

While, in the aforesaid embodiment, the values of color signals are controlled upon D/A conversion, it is understood that such control may be carried out upon A/D conversion. Alternatively, a processor may be used to this end; a signal converting table may be provided in a reference memory thereof.

When the aforesaid color signal conversion means 4R, 4G and 4B are provided separately from the thin-film light emitting devices, problems arise in connection with packaging area and noises. For this reason, it is preferable to mount the color signal conversion means 4R, 4G and 4B on the same substrate as that of a panel that defines the display portion. Preferably in this case, the color signal conversion means 4R, 4G and 4B should be formed on single crystal Si, and then bump-packaged as COG on the panel. Alternatively, the color signal conversion means 4R, 4G and 4B may be formed using polycrystal SiTFT.

When the aforesaid color signal conversion means 4R, 4G and 4B are provided separately from the display portion, an available space on the panel decreases due to some area needed thereon. When video amplifiers are formed using polycrystal SiTFT, cost increases are unavoidable because such TFT is required to have ever-higher quality.

These problems can be solved by the third embodiment of the present invention, wherein the color signal conversion means 4R, 4G and 4B are achieved by controlling, for each color, the input signal/output signal characteristics of a light emission controlling device for driving a thin-film light emission device for each pixel. That is, an active matrix type display system comprises a light emission control device for feeding a driving current to a thin-film display device and a signal selecting device for selecting a signal for controlling the driving current fed to the thin-film display device. Here, the input signal/output signal characteristics of the light emission controlling device for feeding the driving current to the thin-film display device are adjusted to such characteristics as to feed a proper driving current in conformity with the display color of the thin-film light emitting device.

More specifically, the transconductance gm of a bias TFT for driving the thin-film light emitting device is controlled. Transconductance control is gained by varying the L/W ratio of the bias TFT to be formed. Here consider the aforesaid NTSC signals. If the current/luminance conversion efficiency for each of red, green and blue is on the same level and the colors of R (red), G (green) and B (blue) from thin-film light emitting devices are in agreement with the NTSC colors, it is then preferable to control the L/W ratio to R:0.3, G:0.59 and B:0.11. For instance, it is preferable that W=30 $\mu$m for red pixels, W=59 $\mu$m for green pixels and W=11 $\mu$m for blue pixels provided that L is commonly equal to 10 $\mu$m. In actual applications, however, the current/light emission luminance (I/L) conversion efficiency of thin-film light emitting devices varies depending on color, and the color is different from the NTSC color. The optimum values of L and W of TFTs, too, vary depending on the mobility of TFTs, pixel size, etc. It is thus preferable to determine the optimum L/W ratio while the characteristics of thin-film light emitting devices and TFTs are taken into consideration. Preferably in this case, the TFTs should be formed of polysilicon.

No particular limitation is imposed on the thin-film light emitting devices used for the color image display system of the present invention; a current-driven type of various thin-film light emitting devices may be used. In the present invention, organic EL devices are preferred for the thin-film light emitting devices.

The construction of the organic EL device used as the thin-film light emitting device in the present invention is now explained. The organic EL device comprises between a first electrode and a second electrode an organic layer containing at least an organic material taking part in light emission. Electrons and holes given out of the first and second electrodes are recombined together in the organic layer, thereby emitting light.

Either one of the first and second electrodes serves as a hole injecting electrode and the other as an electron injecting electrode. Usually, however, the first electrode on the substrate side serves as the hole injecting electrode and the second electrodes as the electron injecting electrode.

The electron injecting electrode is preferably formed of a material having a low work function such as K, Li, Na, Mg, La, Ce, Ca, Sr, Ba, Al, Ag, In, Sn, Zn and Zr each in a pure metal form. To improve the stability of the electron injecting electrode, it is also preferable to use a binary or ternary alloy system containing such metals. For the alloy system, for instance, use may be made of Ag.Mg (Ag: 0.1 to 50 at %), Al.Li (Li: 0.01 to 14 at %), In.Mg (Mg: 50 to 80 at %) and Al.Ca (Ca: 0.01 to 20 at %) . In this regard, the electron injecting electrode may also be formed by an evaporation or sputtering process.

The electron injecting electrode thin film should preferably have at least a certain thickness enough for injection of electrons; it has a thickness of 0.5 nm or greater, preferably 1 nm or greater and more preferably 3 nm or greater. Although there is no upper limit to the thickness, it is usually preferable that the upper thickness is of the order of 3 to 500 nm. The electron injecting electrode may be provided thereon with an auxiliary or protective electrode.

The evaporation pressure should preferably be between $1\times10^{-8}$ Torr and $1\times10^{-5}$ Torr, and the heating temperature for an evaporation source should preferably be between about 100° C. and about 1,400° C. for a metal material and between about 100° C. and about 500° C. for an organic material.

For the hole injecting electrode, it is preferable to use a transparent or translucent electrode because it is constructed as an electrode out of which emitted light is taken. For the transparent electrode, ITO (tin-doped indium oxide), IZO (zinc-doped indium oxide), ZnO, $SnO_2$, $In_2O_3$ or the like may be used. However, ITO (tin-doped indium oxide) and IZO (zinc-doped indium oxide) are preferred. Usually, ITO contains $In_2O_3$ and $SnO_2$ in stoichiometric composition; however, the amount of O may deviate slightly therefrom. When transparency is not needed for the hole injecting electrode, the hole injecting electrode may be formed of an opaque material as known in the art.

The hole injecting electrode should preferably have at least a certain thickness enough for injection of holes, and so is of preferably 50 to 500 nm, and more preferably 50 to 300 nm in thickness. Although there is no upper limit to the thickness, it is understood that too large a thickness causes concern about defoliation and too small a thickness offers problems in terms of as-produced film thickness, hole transportation capabilities and resistance value.

The hole injecting electrode layer may be formed by an evaporation process or the like. However, preference is given to sputtering processes and especially a pulse DC sputtering process.

The organic EL device according to the present invention should preferably comprise an inorganic electron injecting and transporting layer of high resistance or an inorganic electron injecting layer of high resistance between a light emitting layer and a cathode that is one of the electrodes.

By locating an inorganic electron injecting and transporting layer having an electron conduction path and capable of blocking holes between the organic layer and the electron injecting electrode (cathode), it is thus possible to provide efficient injection of electrons in the light emitting layer and, hence, make improvements in light efficiency with a driving voltage drop.

It is preferable that the second component of the high-resistance inorganic electron injecting and transporting layer or inorganic electron injecting layer is used in an amount of 0.2 to 40 mol % with respect to all components to form a conductive path, because electrons can be efficiently injected from the electron injecting electrode into the organic layer on the light-emitting layer side. In addition, it is possible to prevent migration of holes from the organic layer to the electron injecting electrode, so that the efficiency of recombination of holes and electrons in the light emitting layer can be improved. Further, it is possible to achieve an organic EL device having the merit that an inorganic material has together with the merit that an organic material has. The organic EL device according to the present invention has a luminance equal to or greater than that of a conventional device having an organic electron injecting layer, and has higher heat resistance and weather resistance than ever before. Thus, the organic EL device according to the invention has an ever-longer service life and is less susceptible to leakage and dark spots. By using not only relatively expensive organic materials but also inexpensive, easily available and easy-to-fabricate inorganic materials, it is possible to achieve fabrication cost reductions.

The high-resistance inorganic electron injecting and transporting layer or inorganic electron injecting layer should have a resistivity of preferably 1 to $1\times10^{11}$ Ω·cm, and especially $1\times10^{3}$ to $1\times10^{8}$ Ω·cm. If the resistivity of the high-resistance inorganic electron injecting and transporting layer is in the aforesaid range, it is then possible to achieve striking improvements in electron injection efficiency while its ability to block electrons is kept high. The resistivity of the high-resistance inorganic electron injecting and transporting layer may be found from sheet resistance and film thickness.

Preferably, the high-resistance inorganic electron injecting and transporting layer or inorganic electron injecting layer should comprise as the first component an oxide having a work function of 4 eV or less, and especially 1 to 4 eV, said oxide being an oxide of:

preferably at least alkaline metal element selected from Li, Na, K, Rb, Cs and Fr, or preferably at least alkaline earth metal selected from Mg, Ca and Sr, or preferably at least one lanthanoid element selected from La and Ce. Among others, lithium oxide, magnesium oxide, calcium oxide, and cerium oxide are particularly preferred. For use, these oxides may be mixed together at any desired mixing ratio. The mixture should preferably contain 50 mol % or greater of lithium oxide as calculated on a $Li_2O$ basis.

The high-resistance inorganic electron injecting and transporting layer or inorganic electron injecting layer further comprises as the second component at least one element selected from Zn, Sn, V, Ru, Sm and In. The content of the second component should be preferably between 0.2 mol % and 40 mol %, and more preferably between 1 mol % and 20 mol %. At less than 0.2 mol % the electron injecting function becomes low, and at greater than 40 mol % the hole blocking function becomes low. When two or more such elements are used in combination, it is preferable that the total content thereof is in the aforesaid range. The second component may be present in a metal element or oxide form.

By incorporating the second component having conductivity (low resistance) in the first component having high resistance, it is believed that the conductive substance in an island form is present in the insulating material so that a hopping path for electron injection is formed.

The first component oxide is usually found with stoichiometric composition. However, a slight deviation from the stoichiometric composition or a non-stoichiometric composition is acceptable. The second component, too, is usually present in the form of an oxide, for which the same holds.

The high-resistance inorganic electron injecting and transporting layer or inorganic electron injecting layer may further contain as impurities H, and Ne, Ar, Kr, Xe, etc. used for sputtering gases in a total amount of 5 at % or less.

It is here noted that if the high-resistance inorganic electron injecting and transporting layer or inorganic electron injecting layer has such an average composition as a whole, it is not always required that the layer is uniform. In other words, the layer may have a concentration gradient in its thickness direction.

The high-resistance inorganic electron injecting and transporting layer or inorganic electron injecting layer is usually present in a non-crystalline state.

The high-resistance inorganic electron injecting and transporting layer or inorganic electron injecting layer should have a thickness of preferably 0.2 to 30 nm and more preferably about 0.2 to 20 nm. Too thick or thin an electron injecting layer fails to perform its own function.

The high-resistance inorganic electron injecting and transporting layer or inorganic electron injecting layer may be fabricated by various physical or chemical thin-film formation processes such as sputtering processes, and evaporation processes, with the sputtering processes being preferred. In particular, it is preferable to use a multi-sputtering process wherein targets for the first and second components are separately sputtered. With the multi-sputtering process, it is possible to use suitable sputtering processes for the respective targets. When a single sputtering process is used, it is acceptable to use a mixed target of the first and second components. thickness, the cathode may usually have a thickness of the order of 50 to 500 nm. It is here to be noted that when emitted light is taken out of the cathode side, the cathode has preferably a thickness of the order of 50 to 300 nm.

The organic EL structure is built up of the following organic layers.

The light emitting layer has functions of injecting holes and electrons, transporting them, and recombining holes and electrons to create excitons. For the light emitting layer, it is preferable to use a relatively electronically neutral compound.

The hole injecting and transporting layer has functions of facilitating injection of holes from the hole injecting electrode, providing stable transportation of holes and blocking electrons. The electron injecting and transporting layer has functions of facilitating injection of electrons from the electron injecting electrode and transporting layer, providing stable transportation of electrons and blocking holes. These layers are effective for increasing the number of holes and electrons injected into the light emitting layer and confining holes and electrons therein for optimizing the recombination region to improve light emission efficiency.

No particular limitation is imposed on the thickness of the light emitting layer, the thickness of the hole injecting and transporting layer, and the thickness of the electron injecting and transporting layer. However, these layers should preferably have a thickness of the order of usually 5 to 500 nm, and especially 10 to 300 nm although varying depending on formation processes.

The thicknesses of the hole injecting and transporting layer, and the electron injecting and transporting layer are approximately equal to, or range from about 1/10 times to about 10 times as large as, the thickness of the light emitting layer although they depend on the design of the recombination/light emitting region. When the hole or electron injecting and transporting layer is separated into When the high-resistance inorganic electron injecting and transporting layer or inorganic electron injecting layer are formed by the sputtering process, it is preferable that the pressure of the sputtering gas during sputtering is in the range of 0.1 to 1 Pa. For the sputtering gas, inert gases used with an ordinary sputtering system, for instance, Ar, Ne, Xe, and Kr may be used. If required, $N_2$ may be used. Reactive sputtering, too, may be used with a sputtering atmosphere comprising a mixture of the sputtering gas with about 1 to 99% of $O_2$.

For the sputtering process, an RF sputtering process using an RF power source, a DC sputtering process, etc. may be used. Power for a sputtering system is preferably in the range of 0.1 to 10 W/cm$^2$ for RF sputtering, and the film deposition rate is preferably in the range of 0.5 to 10 nm/min., and especially 1 to 5 nm/min.

During film deposition, the substrate temperature is of the order of room temperature (25° C.) to 150° C.

A cathode is located on the inorganic electron injecting and transporting layer or inorganic electron injecting layer (that faces away from the light emitting layer: below the inorganic insulating electron injecting and transporting layer in a so-called reverse multilayer arrangement). For the cathode used in combination with the inorganic insulating electron injecting and transporting layer, an ordinary metal rather than a special metal may be used because it is not required to have electron injection capability with a low work function. Especially in view of conductivity and ease of handling, it is preferable to use one or two metal elements selected from the group consisting of Al, Ag, In, Ti, Cu, Au, Mo, W, Pt, Pd, and Ni, and especially Al and Ag.

The cathode thin film may have at least a certain thickness enough to impart electrons to the inorganic insulating electron injecting and transporting layer or a thickness of at least 50 nm, and preferably at least 100 nm. Although there is no particular upper limit to the cathode an injecting layer and a transporting layer, it is preferable that the injecting layer is at least 1 nm thick and the transporting layer is at least 1 nm thick. The upper limit to the thickness is usually about 500 nm for the injecting layer and about 500 nm for the transporting layer. The same film thickness is also true of the case where two injecting and transporting layers are provided.

In the organic EL device according to the present invention, the light emitting layer contains a fluorescent material that is a compound capable of emitting light. The fluorescent material used herein, for instance, may be at least one compound selected from compounds such as those disclosed in JP-A 63-264692, e.g., quinacridone, rubrene, and styryl dyes. Use may also be made of quinoline derivatives such as metal complex dyes containing 8-quinolinol or its derivative as ligands, for instance, tris(8-quinolinolato) aluminum, tetraphenylbutadiene, anthracene, perylene, coronene, and 12-phthaloperinone derivatives. Use may further be made of phenylanthracene derivatives disclosed in JP-A 8-12600 and tetraarylethene derivatives disclosed in JP-A 8-12969.

Preferably, the fluorescent compound is used in combination with a host substance capable of emitting light by itself; that is, it is preferable that the fluorescent compound is used as a dopant. In such a case, the content of the fluorescent compound in the light emitting layer is in the range of preferably 0.01 to 20% by volume, and especially 0.1 to 15% by volume. The content of rubrene in particular is preferably 0.01 to 20% by volume. By using the fluorescent compound in combination with the host substance, it is possible to vary the wavelength performance of light emission of the host substance, thereby making light emission possible on a longer wavelength side and, hence, improving the light emission efficiency and stability of the device.

Quinolinolato complexes, and aluminum complexes containing 8-quinolinol or its derivatives as ligands are preferred for the host substance. Such aluminum complexes are typically disclosed in JP-A's 63-264692, 3-255190, 5-70773, 5-258859, 6-215874, etc.

Exemplary aluminum complexes include tris(8-quinolinolato)aluminum, bis(8-quinolinolato)magnesium, bis(benzo{f}-8-quinolinolato)zinc, bis(2-methyl-8-quinolinolato)aluminum oxide, tris(8-quinolinolato)indium, tris(5-methyl-8-quinolinolato)aluminum, 8-quinolinolato-lithium, tris(5-chloro-8-quinolinolato)gallium, bis(5-chloro-8-quinolinolato)calcium, 5,7-dichloro-8-quinolinolato-aluminum, tris(5,7-dibromo-8-hydroxyquinolinolato) aluminum, and poly[zinc(II)-bis(8-hydroxy-5-quinolinyl) methane].

Other preferable host substances include phenylanthracene derivatives disclosed in JP-A 8-12600 (Japanese Patent Application No. 6-110569), tetraarylethene derivatives disclosed in JP-A 8-12969 (Japanese Patent Application No. 6-114456), etc.

In the practice of the present invention, the light emitting layer may also serve as an electron injecting and transporting layer. In this case, it is preferable to use tris(8-quinolinolato)aluminum or the like. These fluorescent materials may be provided by evaporation.

If necessary or preferably, the light emitting layer is formed of a mixed layer of at least one compound capable of injecting and transporting holes with at least one compound capable of injecting and transporting electrons. Preferably in this case, a dopant is incorporated in the mixed layer. The content of the dopant compound in the mixed layer is in the range of preferably 0.01 to 20% by volume, and especially 0.1 to 15% by volume.

In the mixed layer with a hopping conduction path available for carriers, each carrier migrates in the polarly prevailing substance, so making the injection of carriers having an opposite polarity unlikely to occur. This leads to an increase in the service life of the device due to less damage to the organic compound. By incorporating the aforesaid dopant in such a mixed layer, it is possible to vary the wavelength performance of light emission that the mixed layer itself possesses, thereby shifting the wavelength of light emission to a longer wavelength side and improving the intensity of light emission, and the stability of the device as well.

The compound capable of injecting and transporting holes and the compound capable of injecting and transporting electrons, both used to form the mixed layer, may be selected from compounds for the injection and transportation of holes and compounds for the injection and transportation of electrons, as will be described later. Especially for the compounds for the injection and transportation of holes, it is preferable to use amine derivatives having strong fluorescence, for instance, hole transporting materials such as triphenyldiamine derivatives, styrylamine derivatives, and amine derivatives having an aromatic fused ring.

For the compounds capable of injecting and transporting electrons, it is preferable to use metal complexes containing quinoline derivatives, especially 8-quinolinol or its derivatives as ligands, in particular, tris(8-quinolinolato)aluminum (Alq3). It is also preferable to use the aforesaid phenylanthracene derivatives, and tetraarylethene derivatives.

For the compounds for the injection and transportation of holes, it is preferable to use amine derivatives having strong fluorescence, for instance, hole transporting materials such as triphenyldiamine derivatives, styrylamine derivatives, and amine derivatives having an aromatic fused ring.

In this case, the ratio of mixing the compound capable of injecting and transporting holes with respect to the compound capable of injecting and transporting electrons is determined while the carrier mobility and carrier density are taken into consideration. In general, however, it is preferred that the weight ratio between the compound capable of injecting and transporting holes and the compound capable of injecting and transporting electrons is of the order of 1/99 to 99/1, particularly 10/90 to 90/10, and more particularly 20/80 to 80/20.

The thickness of the mixed layer should preferably be equal to or larger than the thickness of a single molecular layer, and less than the thickness of the organic compound layer. More specifically, the mixed layer has a thickness of preferably 1 to 85 nm, more preferably 5 to 60 nm, and even more preferably 5 to 50 nm.

Preferably, the mixed layer is formed by co-evaporation where the selected compounds are evaporated from different evaporation sources. When the compounds to be mixed have identical or slightly different vapor pressures (evaporation temperatures), however, they may have previously been mixed together in the same evaporation board for the subsequent evaporation. Preferably, the compounds are uniformly mixed together in the mixed layer. However, the compounds in an island form may be present in the mixed layer. The light emitting layer may generally be formed at a given thickness by the evaporation of the organic fluorescent substance or coating a dispersion of the organic fluorescent substance in a resin binder.

For the hole injecting and transporting layer, use may be made of various organic compounds as disclosed in JP-A's 63-295695, 2-191694, 3-792, 5-234681, 5-239455, 5-299174, 7-126225, 7-126226 and 8-100172 and EP 0650955A1. Examples are tetraarylbenzidine compounds (triaryldiamine or triphenyl-diamine (TPD)), aromatic tertiary amines, hydrazone derivatives, carbazole derivatives, triazole derivatives, imidazole derivatives, oxadiazole derivatives having an amino group, and polythiophenes. The compounds may be used singly or in combination of two or more. Where two or more such compounds are used, they may be stacked as separate layers, or otherwise mixed.

When the hole injecting and transporting layer is provided as a separate hole injecting layer and a separate hole transporting layer, two or more compounds are selected in a preferable combination from the compounds already mentioned for the hole injecting and transporting layer. In this regard, it is preferable to laminate layers in such an order that a compound layer having a lower ionization potential is disposed contiguous to the hole injecting electrode (ITO, etc.). It is also preferable to use a compound having good thin-film formation capability at the surface of the hole injecting electrode. This order of lamination holds for the provision of two or more hole injecting and transporting layers, and is effective as well for lowering driving voltage and preventing the occurrence of current leakage and the appearance and growth of dark spots. Since deposition by evaporation is utilized for device fabrication, films as thin as about 1 to 10 nm can be formed in a uniform and pinhole-free state, which restrains any change in color tone of emitted light and a drop of efficiency by re-absorption even if a compound having a low ionization potential and absorption in the visible range is used in the hole injecting layer. The hole injecting and transporting layer may be formed by the evaporation of the aforesaid compound as is the case with the light emitting layer.

For the electron injecting and transporting layer used when the organic electron injecting and transporting layer is provided, there may be used quinoline derivatives such as organic metal complexes containing 8-quinolinol or its derivatives as ligands, for instance, tris(8-quinolinolato) aluminum (Alq3), oxadiazole derivatives, perylene derivatives, pyridine derivatives, pyrimidine derivatives, quinoxaline derivative, diphenylquinone derivatives, and nitro-substituted fluorene derivatives. The electron injecting and transporting layer may also serve as a light emitting layer. In this case, it is preferable to use tris(8-quinolilato) aluminum, etc. The electron injecting and transporting layer may be formed as by evaporation, as is the case with the light emitting layer.

When the electron injecting and transporting layer is provided as a separate electron injecting layer and a separate electron transporting layer, two or more compounds are selected in a preferable combination from the compounds already mentioned for the electron injecting and transporting layer. In this regard, it is preferable to laminate layers in such an order that a compound layer having a larger electron affinity is disposed contiguous to the electron injecting electrode. This order of lamination holds for the provision of two or more electron injecting and transporting layers.

Preferably, the hole injecting and transporting layer, the light emitting layer, and the electron injecting and transporting layer are formed by a vacuum evaporation process because a uniform thin film can then be obtained. With the vacuum evaporation process, it is thus possible to obtain a uniform thin film in an amorphous state or with a grain size of up to 0.2 $\mu$m. A grain size of greater than 0.2 $\mu$m results in non-uniform light emission. To avoid this, it is required to make the driving voltage of the device high. However, this in turn gives rise to some considerable drop of charge injection efficiency.

No particular limitation is imposed on conditions for vacuum evaporation. However, the vacuum evaporation should preferably be carried out at a degree of vacuum of up to $10^{-4}$ Pa and a film deposition rate of about 0.01 to 1 nm/sec. Also, the layers should preferably be continuously formed in vacuum, partly because the deposition of impurities on the interface between adjacent layers is avoidable resulting in the achievement of high performance, and partly because the driving voltage of the device can be lowered with elimination of dark spots or no growth of dark spots.

When the layers, each containing a plurality of compounds, are formed by the vacuum evaporation process, it is preferable that co-evaporation is carried out while each board with the compounds charged therein is placed under temperature control.

The substrate may be provided with a color filter film or a color conversion film containing a fluorescent material or a dielectric reflecting film for control of emitted colors.

For the color filter film, use may be made of a color filter commonly used with liquid crystal displays, etc. Preferably in this case, however, the properties of the color filter used should be controlled in conformity with the colors of light emitted from an organic EL device to optimize light extraction efficiency and color purity.

If use is made of a color filter capable of cutting off extraneous light of such short wavelengths as absorbed by the EL device material or fluorescence conversion layer, it is then possible to improve the light resistance of the device and the contrast of what is displayed thereon.

Alternatively, an optical thin film such as a dielectric multilayer film may be used in place of the color filter.

The organic EL device according to the present invention is generally of the DC drive type or pulse drive type. The applied voltage is usually of the order of 2 to 30 volts.

EXAMPLE

One embodiment of the thin-film transistor (TFT) is now explained with reference to the accompanying drawings. FIGS. 4 through 10 are schematic sketches for one exemplary fabrication process of a TFT forming part of the image display system according to the present invention, especially a light emission current driving TFT through which a driving current for the organic EL device is passed.

Figure 4:
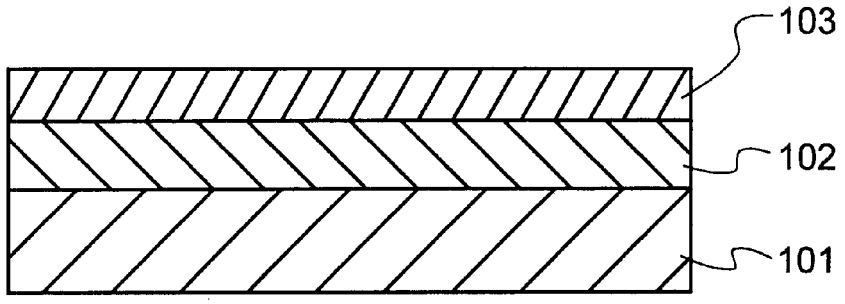
FIG. 4 is a partly sectioned sketch illustrative of the fabrication process of an organic EL device driver (TFT).

(1) As shown in FIG. 4, for instance, a quartz substrate was used as a substrate 101. An $SiO_2$ film 102 of about 100 nm in thickness was formed on this substrate 101 by a sputtering process.

(2) Then, an amorphous Si(a-Si) layer 103 of about 100 nm in thickness was formed on the $SiO_2$ film 102 by an LPCVD process, as shown in FIG. 4.

The then film-deposition conditions are set out below.

$Si_2H_6$ Gas 100 to 500 SCCM

He Gas 500 SSCM

Pressure 0.1 to 1 Torr

Heating Temperature 430 to 500° C.

(3) Then, the assembly was thermally treated, for instance, under the following solid-phase growth conditions, to effect solid-phase growth of the a-Si layer 103 and thereby obtain polysilicon.

First Treatment:

$N_2$ 1 SLM

Treating Temperature 600° C.

Treating Time 5 to 20 hours

Second Treatment:

Treating Temperature 850° C.

Treating Time 0.5 to 3 hours

Figure 5:
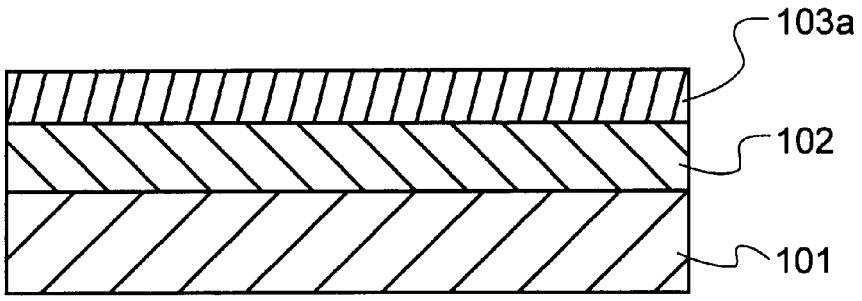
FIG. 5 is a partly sectioned sketch illustrative of the fabrication process of the organic EL device driver (TFT).

In this way, the a-Si layer 103 can be converted to such an active Si layer 103*a* as shown in FIG. 5.

Figure 6:
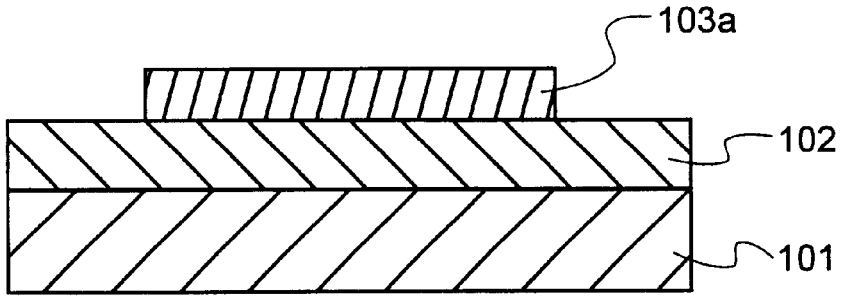
FIG. 6 is a partly sectioned sketch illustrative of the fabrication process of the organic EL device driver (TFT).

(4) Then, the polysilicon layer 103*a* formed at (3) above was patterned for island formation, as shown in FIG. 6.

Figure 7:
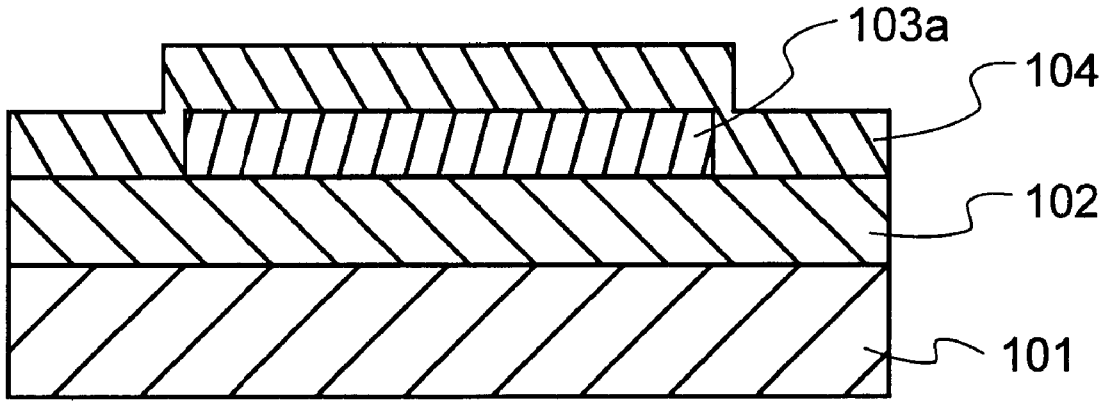
FIG. 7 is a partly sectioned sketch illustrative of the fabrication process of the organic EL device driver (TFT).

(5) Further, the thus patterned polysilicon layer 103*a* was provided thereon with a gate oxide film 104, as shown in FIG. 7.

The conditions for forming this gate oxide film 104, for instance, are as follows.

$H_2$ 4 SLM $O_2$ 10 SCCM

Treating Temperature 800° C.

Figure 8:
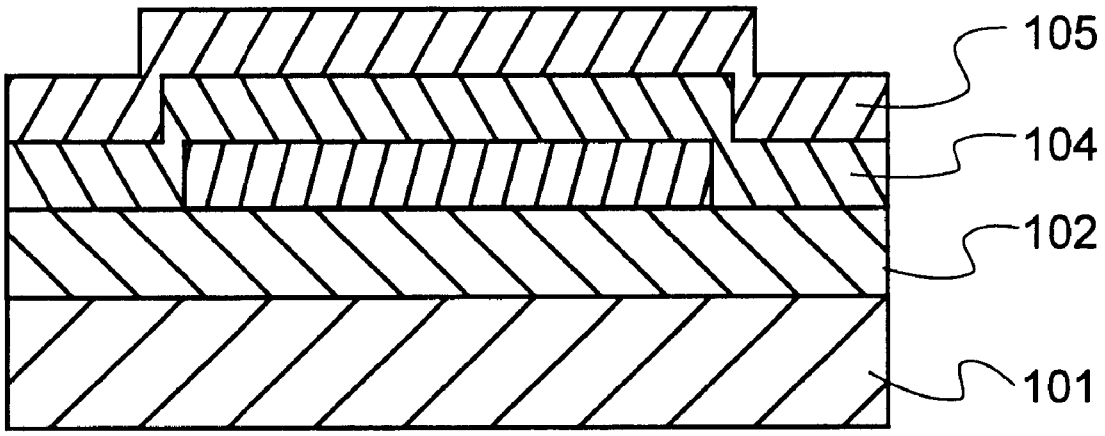
FIG. 8 is a partly sectioned sketch illustrative of the fabrication process of the organic EL device driver (TFT).

Treating Time 5 hours (6) Then, a silicon layer 105 providing a gate electrode was formed at a thickness of 250 nm on the gate oxide film 104 by a reduced-pressure CVD process, as shown in FIG. 8. The then film-deposition conditions, for instance, are as follows.

Gas containing 0.1% of $PH_3$ 200 SCCM

Treating Temperature 640° C.

Figure 9:
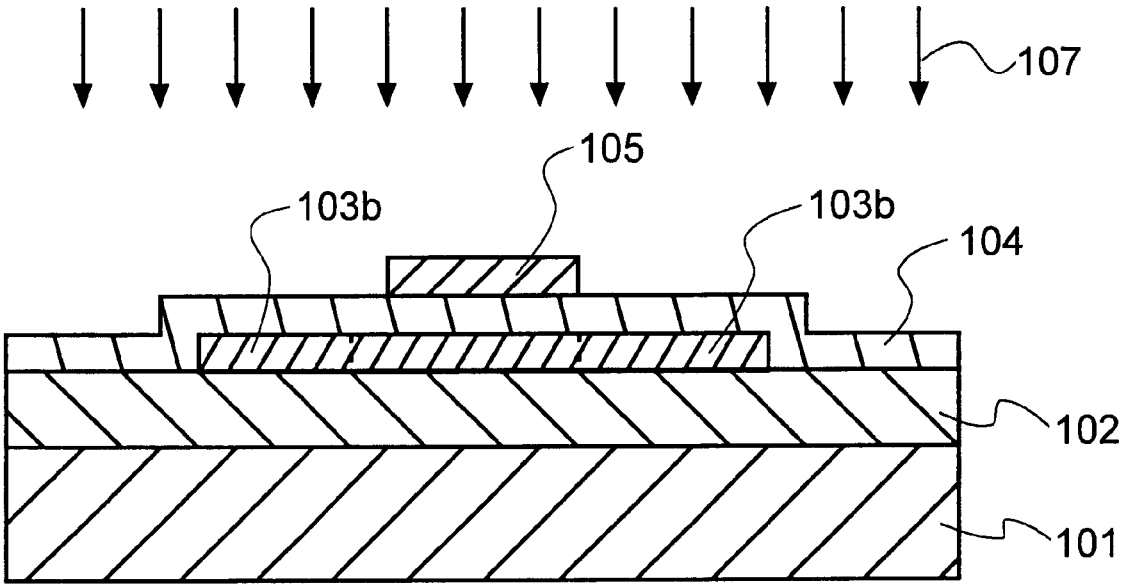
FIG. 9 is a partly sectioned sketch illustrative of the fabrication process of the organic EL device driver (TFT).

Treating Time 0.4 hours (7) Then, the gate electrode 105 and gate oxide film 104 were formed by an etching process according to a given pattern, as shown in FIG. 9.

(8) Further, as shown in FIG. 9, the sites to provide a source-and-drain area were doped with a dopant 107, e.g., phosphorus by an ion doping process using the gate electrode 105 as a mask, thereby forming a source-and-drain area 103*b* in self-alignment with the gate electrode.

(9) The substrate containing these elements was treated at 600° C. for 6 hours in a nitrogen atmosphere, and afterwards heated at 850° C. for a further 30 minutes for activation of the dopant.

Figure 10:
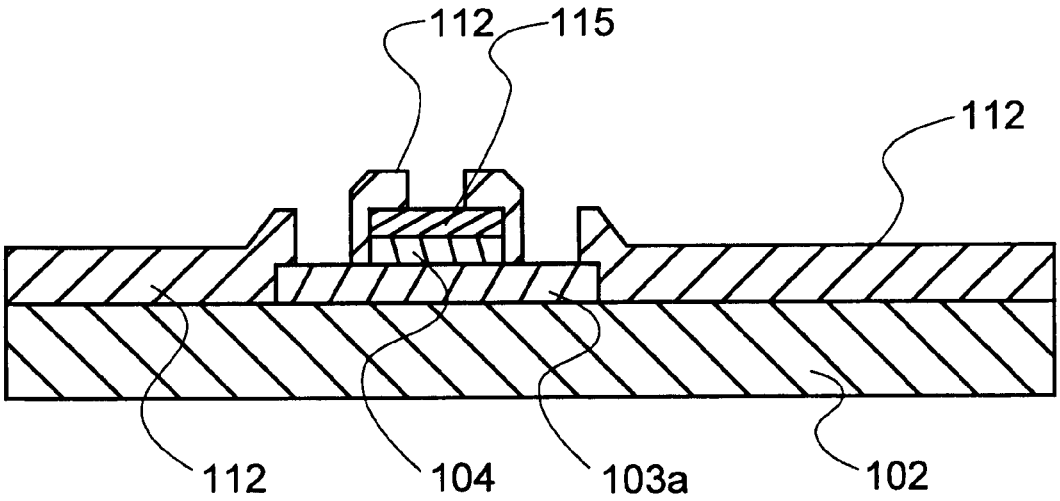
FIG. 10 is a partly sectioned sketch illustrative of the fabrication process of the organic EL device driver (TFT).

(10) Further, as shown in FIG. 10, the starting TEOS material was formed all over the substrate to form an $SiO_2$ film in the form of an interlaminar insulating layer 112 having a thickness of 400 nm. The film-deposition conditions for this $SiO_2$ film, for instance, are as follows.

TEOS Gas 100 SSCM

Heating Temperature 700° C.

Alternatively, an $SiO_2$ film was formed using a plasma TEOS process under the following conditions.

TEOS Gas 10 to 50 SCCM $O_2$ Gas 500 SCCM

Power 50 to 300 W

Treating Temperature 600° C.

After the $SiO_2$ film had been formed on the substrate, the substrate was patterned according to the necessary pattern for interconnecting the electrodes, thereby forming the interlaminar insulating film 112, etc.

(11) Then, a metal thin film for electrodes (not shown) was patterned to form a thin-film transistor.

(12) The thus formed thin-film transistor was thermally treated at 350° C. for 1 hour in a hydrogen atmosphere for hydrogenation, thereby reducing the defect level density of a semiconductor layer.

(13) After another $SiO_2$ film had been formed all over the substrate as in the case of (10), the substrate was patterned according to the necessary pattern for interconnecting electrodes, thereby forming an interlaminar insulating film, etc.

(14) Various color filters were formed on the thus patterned substrate by photolithography.

The thus formed TFTs were used to set up the following driving circuit.

Figure 11:
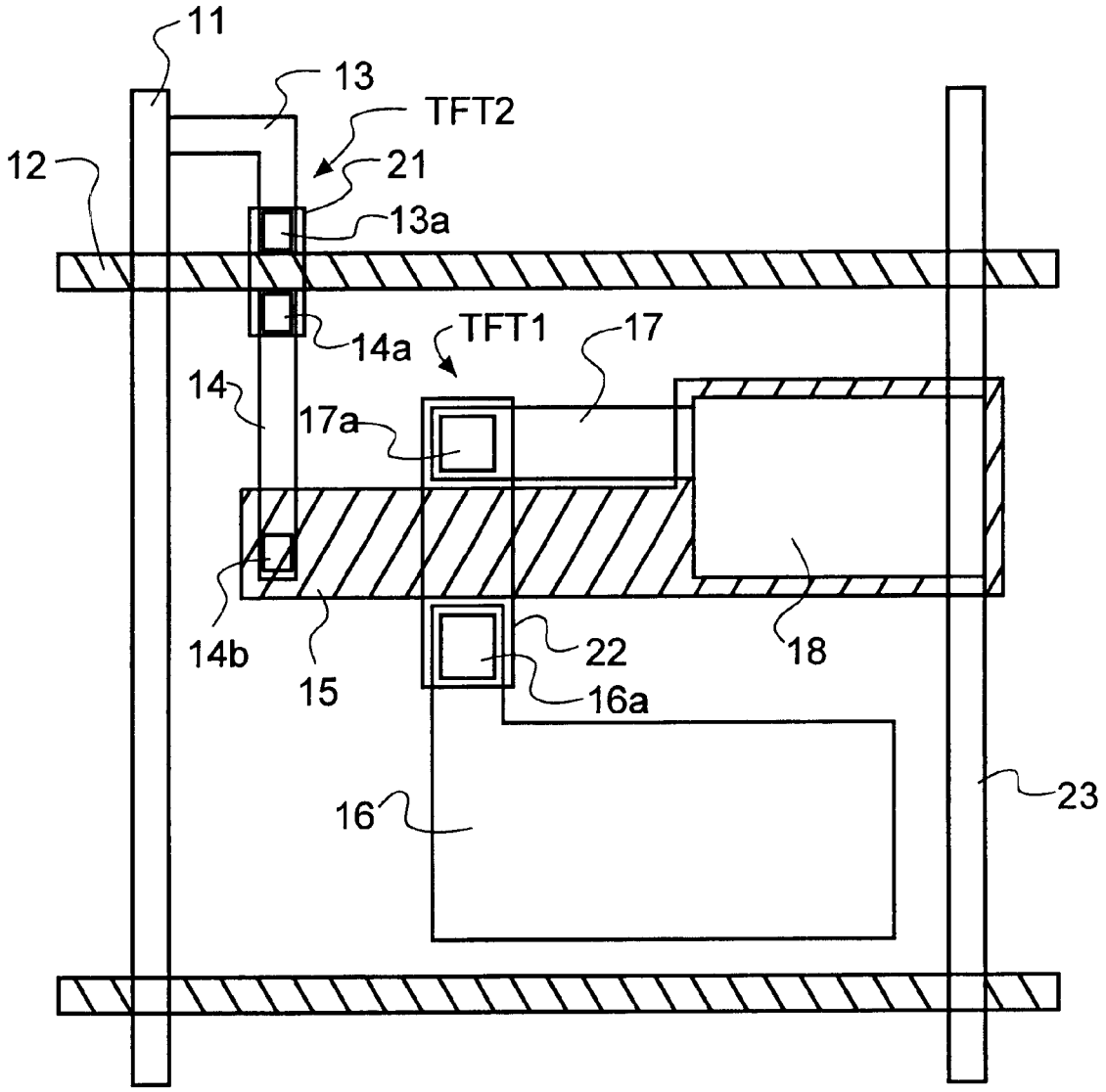
FIG. 11 is a plan view illustrative of one embodiment of the organic EL device driver (TFT).
Figure 12:
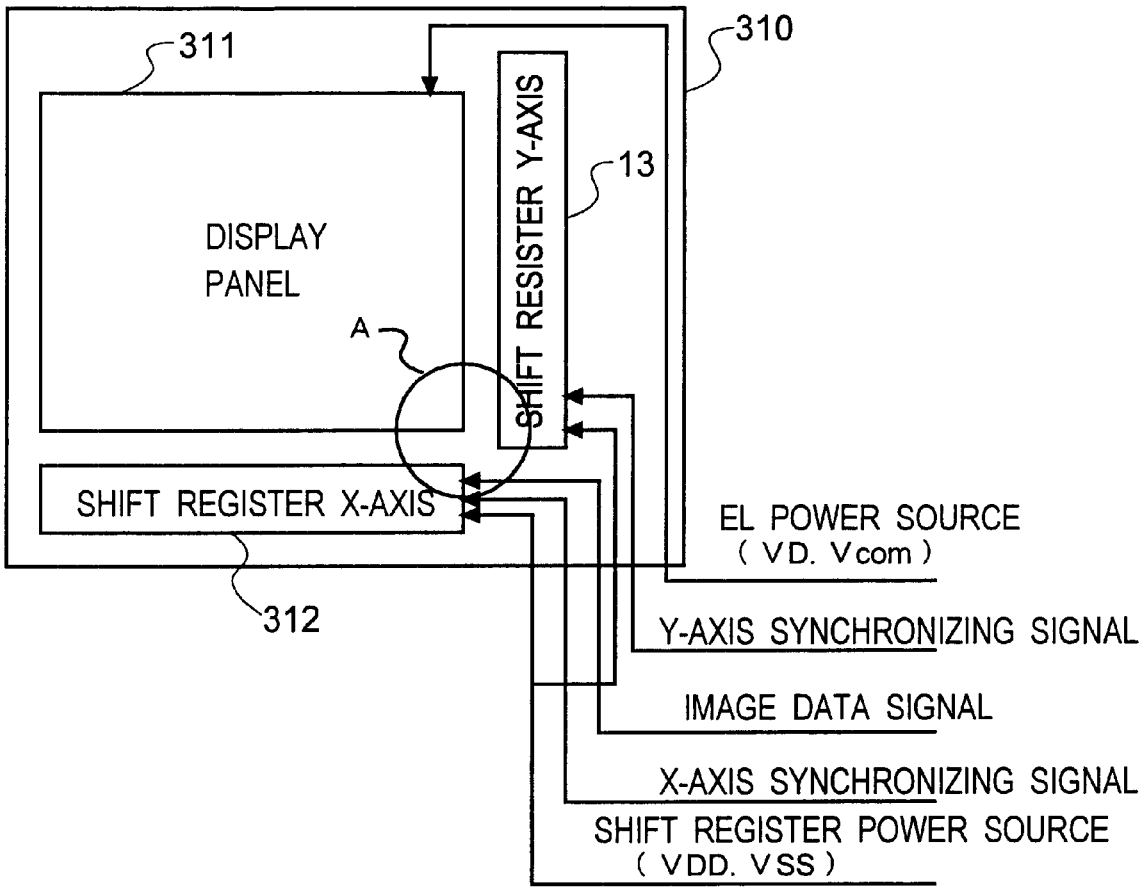
FIG. 12 is a circuit diagram illustrative of a driver for an active matrix type organic EL device.
Figure 13:
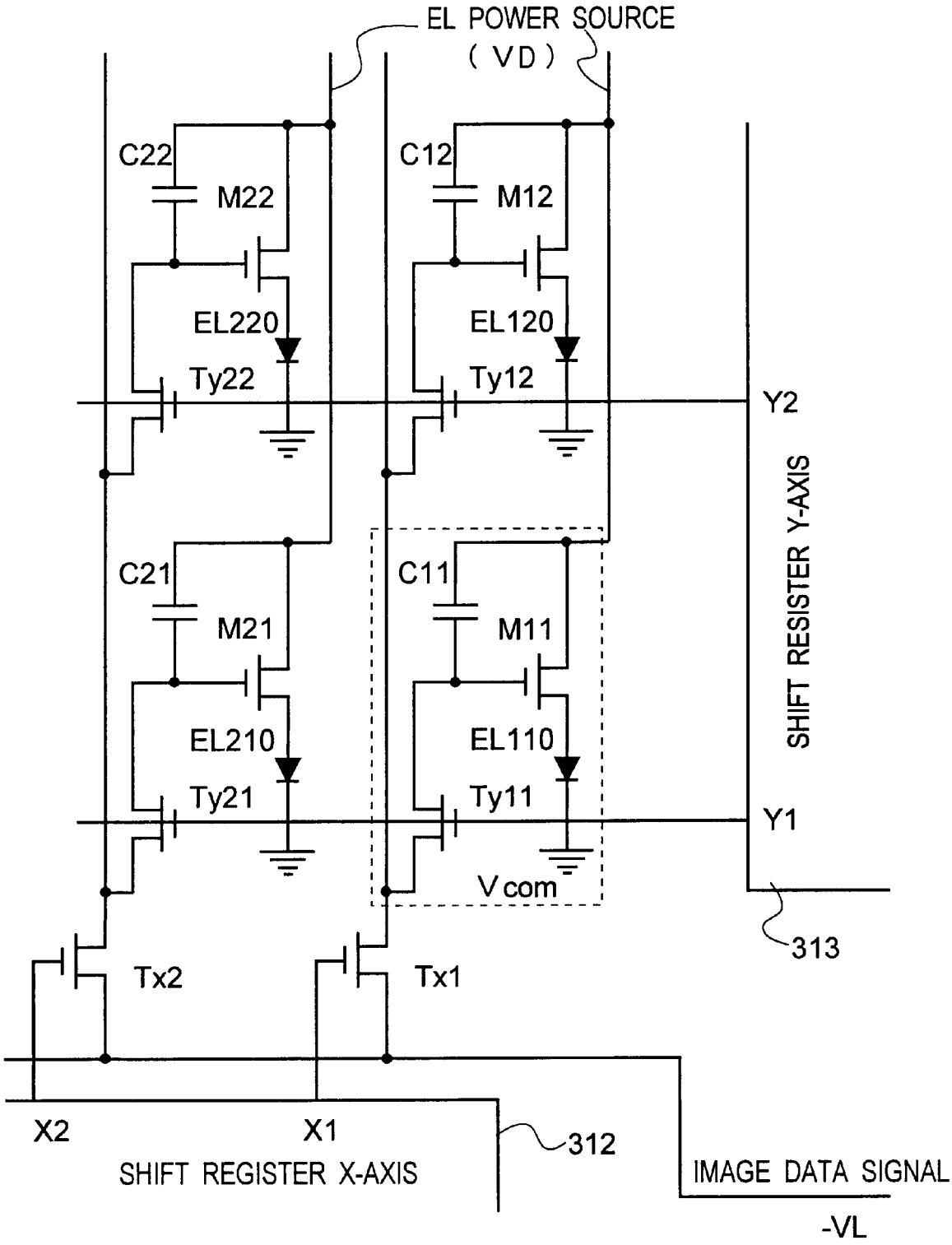
FIG. 13 is an enlarged view for a region indicated by A in FIG. 12.

FIG. 11 is a plan view illustrative of one exemplary TFT array for driving the organic EL device.

Referring here to FIG. 11, a source bus 11 is connected with a source electrode 13, which is in turn connected to a source site formed on a silicon substrate 21 via a contact hole 13*a*. This silicon substrate 21 is provided thereon with a gate bus 12 commonly connected to a TFT element for other pixel (not shown). A gate electrode is formed at a site where this gate bus 12 intersects the silicon substrate 21.

A drain site formed on the silicon substrate with the source site and gate electrode sandwiched between them is connected with a drain wire 14 via a contact hole 14*a*. This drain wire 14 is connected to a gate line 15 via a contact hole 14*b*, which gate line 15 is then formed on a silicon substrate 22 forming a TFT2 while it is connected to one electrode of a capacitor 18. The other electrode of the capacitor 18 is connected to an earth bus 23 and a source electrode 17. This source electrode 17 is connected to a source site of a TFT1 via a contact hole 17*a*. A gate electrode is thus formed at a site where the gate line 15 intersects the silicon substrate 22.

A drain site formed on the silicon substrate with the source site and gate electrode 15 sandwiched between them is connected with a drain wire 16 via a contact hole 16*a*. This drain wire 16 forms one electrode of an organic EL device providing a pixel or is connected thereto.

TFT1 directly driving the organic EL device that is a thin-film display device corresponds to a light emission control device according to the present invention, while TFT2 driving this light emission control device corresponds to a signal selection device to select a signal for controlling a driving current. The source bus 11 and gate bus 12 are each connected with a selection circuit (not shown).

In the instant example, the L/W ratio of the aforesaid light emission control device was controlled in such a way as to have a proper value while white light emission obtained from the following organic materials and the coloration, luminance, etc. of each of red, green and blue obtained by passing the white color through color filters are taken into consideration.

For the color filters, a pigment dispersed type of color filter are located for each pixel in such a way that red (R), green (G) and blue (B) are obtained from white light.

An electron injecting and transporting layer of high resistance and organic layers including a light emitting layer were formed by a vacuum evaporation process on a pixel area (on ITO) of the thus prepared sample TFT thin-film pattern according to the present invention. Set out below are the materials used for film formation.

The substrate with an ITO electrode layer formed thereon was washed on its surface with $UV/O_3$, and then fixed to a substrate holder in a sputtering system, which was in turn evacuated to $1\times10^{-4}$ Pa or lower.

With the vacuum still kept, a material containing an organic material having a light emitting function as an organic layer was formed. As a hole injecting layer poly (thiophene-2,5-diyl) was formed to a thickness of 10 nm, and as a combined hole transporting and yellow emitting layer TPD doped with 1 wt % of rubrene was formed by co-evaporation to a thickness of 5 nm. The concentration of rubrene is preferably about 0.1 to 10 wt %, at which light emission is achievable with high efficiency. The concentration is preferably determined by the color balance of emitted light, and varies depending on the light intensity and wavelength spectra of the blue emitting layer to be formed later. As the blue emitting layer 4'-bis[(1,2,2-triphenyl)ethenyl] biphenyl was formed to a thickness of 50 nm, and as an electron transporting layer Alq3 was formed to a thickness of 10 nm.

Then, the substrate was passed to the sputtering system, wherein a high-resistance inorganic electron injecting layer was formed to a thickness of 10 nm, using a target obtained by mixing $Li_2O$ with 4 mol % of V. The sputtering gas was composed of Ar at 30 SCCM and $O_2$ at 5 SCCM, and sputtering was carried out at room temperature (25° C.), a film deposition rate of 1 nm/min., an operating pressure of 0.2 to 2 Pa and an input power of 500 W. The composition of the thus formed inorganic electron injecting layer was substantially the same as that of the target.

Then, Al was formed by evaporation to a thickness of 100 nm while the vacuum was still maintained, thereby obtaining a cathode. Finally, glass sealing was carried out to obtain an organic EL device.

The obtained organic EL display system was driven with the NTSC standard white signals entered therein to measure the color coordinates of white light emitted from a display screen. It was consequently found that white light emission can be obtained with extremely high reproducibility, as indicated by x=0.310 and y=0.316.

EFFECTS OF THE INVENTION

According to the present invention explained above, it is possible to provide a color image display system which can achieve a proper color display and so form an image of high image quality, even when colors of light emitted from thin-film display devices are delicately different from NTSC or other image signals or the current/luminance conversion efficiencies for various colors are not the same level.

Japanese Patent Application No. 351604/1999 is incorporated herein by reference.

Although some preferable embodiments have been described, many modifications and variations may be made thereto in the light of the above teachings. It is therefore to be understood that within the scope of the appended claims, the invention may be practiced otherwise than as specifically described.

I claim:

1. A color image display system comprising a thin-film, organic EL, display device driven by a current for each pixel and designed to display colors corresponding to a plurality of color signals, which further comprises:

a color signal conversion means for converting a color signal ratio of said plurality of color signals of a color signal source to a second ratio of signals in accordance with properties of said thin-film, organic EL, display device, whereby illuminance of white color signals is improved.

2. The color image display system according to claim 1, wherein said color signal conversion means is formed on the same substrate as that of said thin-film display devices.

3. The color image display system according to claim 1 or 2, which further comprises a light emission controlling device for feeding a driving current to at least said thin-film display devices, and wherein said color signal conversion means is controlled in such a way that input signal/output signal characteristics of said light emission controlling device correspond to each color to be displayed.

4. The color image display system according to claim 3, wherein said light emission controlling device is a polysilicon TFT.

5. The color image display system according to claim 3 or 4, wherein said input signal/output signal characteristics are a TFT transconductance.

6. A color image display system comprising a thin-film, organic EL, display device driven by a current for each pixel and designed to display colors corresponding to a plurality of color signals, which further comprises:

a color signal conversion means for converting a color signal ratio of said plurality of color signals of a color signal source to a ratio of signals compensated for the light emission luminance characteristics of the thin film, organic EL display device whereby illuminance of white color signals is improved.

* * * * *